US006640865B1

(12) United States Patent
Morikawa

(10) Patent No.: US 6,640,865 B1
(45) Date of Patent: Nov. 4, 2003

(54) LABEL ATTACHING APPARATUS

(75) Inventor: Hajime Morikawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/574,014

(22) Filed: May 19, 2000

(30) Foreign Application Priority Data

May 21, 1999 (JP) ..... 11-142443

(51) Int. Cl.[7] ..... B65C 9/08; B65C 9/14; B65C 9/18

(52) U.S. Cl. ..... 156/542; 156/556; 156/566; 156/571; 156/DIG. 28; 156/DIG. 31

(58) Field of Search ..... 156/542, 571, 156/556, 540, 363, 566, 364, 584, 541, DIG. 31, DIG. 28, DIG. 42; 221/210, 211, 278; 248/363

(56) References Cited

U.S. PATENT DOCUMENTS

| | | | | | |
|---|---|---|---|---|---|
| 3,262,832 | A | | 7/1966 | Fairest | 156/455 |
| 3,554,841 | A | | 1/1971 | Wysocki et al. | 156/455 |
| 3,984,277 | A | | 10/1976 | French et al. | 156/497 |
| 4,392,913 | A | * | 7/1983 | Baumli | 156/584 |
| 4,526,648 | A | * | 7/1985 | Tochtermann | 156/497 |
| 4,556,443 | A | | 12/1985 | Moya | 156/356 |
| 4,680,082 | A | * | 7/1987 | Kearney | 156/497 |
| 4,844,771 | A | * | 7/1989 | Crankshaw et al. | 156/387 |
| 5,092,954 | A | * | 3/1992 | Braun et al. | 156/540 |
| 5,232,540 | A | * | 8/1993 | Southwell et al. | 156/361 |
| 5,750,004 | A | | 5/1998 | Wurz et al. | 156/360 |
| 5,853,530 | A | * | 12/1998 | Allen | 156/541 |
| 5,865,918 | A | * | 2/1999 | Franklin et al. | 156/64 |

FOREIGN PATENT DOCUMENTS

| | | |
|---|---|---|
| DE | 31 24 337 C2 | 4/1982 |
| DE | 36 23 366 A1 | 2/1988 |
| EP | 0 476 447 A1 | 3/1992 |
| JP | S61-097105 | 6/1986 |
| JP | S61-178827 A | 8/1986 |
| JP | H1-110115 U | 7/1989 |
| JP | H1-176013 U | 12/1989 |
| JP | H09-080700 A | 3/1997 |
| JP | H11-070927 A | 3/1999 |

* cited by examiner

*Primary Examiner*—Richard Crispino
*Assistant Examiner*—Sue A. Purvis
(74) *Attorney, Agent, or Firm*—Sughrue Mion, PLLC

(57) ABSTRACT

An object of the invention of the present application is to provide a label holder which reliably attaches a label on a required position of a material to which the label will be attached, without wrinkles; in order to achieve the object, the present invention provide a label attaching apparatus for attaching a label on the material, comprising a label holder provided with a label sucking face for sucking and holding the label wherein said label holder comprises at least one air blowout chamber for supplying air supplied from an air source into a plurality of air blowout pipes having openings formed at the label sucking face and at least one air suction chamber for dividing negative pressure due to the air suction source into a plurality of air suction pipes having openings formed at the label sucking face.

11 Claims, 9 Drawing Sheets

LABEL ATTACHING APPARATUS

BACKGROUND OF THE INVENTION

1. Field of the Invention

The present invention relates to a label attaching apparatus for attaching a label displaying printed information associated with a material, such as a box, a product, etc. wherein the label is attached on the material transferred by a transfer device.

This application is based on Japanese Patent Application No. Hei 11-142443, the contents of which are incorporated herein by reference.

2. Description of the Related Art

A label attaching apparatus, wherein a label displaying information associated with a material, such as a mail, a product, etc. (abbreviated as "material" below) which the label will be attached, for example, using a bar code, is automatically attached on the material, has been used.

The conventional label attaching apparatus comprises a material transfer mechanism for carrying the material, such as conveyor, a label transfer mechanism for carrying a label printed information associated with the material, a label holder for receiving the label from the label transfer mechanism and transferring the label to the material, and a label attaching member for pressing the label to the material, in order to attach the label on the material.

This type of label attaching apparatus is disclosed in Japanese Patent Applications, First Publication Nos. Hei 10-264915 and 10-101044, and Second Publication (Kokai) No. Hei 07-084215. Most of this type of label attaching apparatus comprises a label holder that holds the label by air suction. The label attaching apparatus comprising the air suction type label holder has the effects of simplifying and miniaturizing the device. Moreover, when the label is transferred from the label holder to the material, the label holder blows air and the air presses the label against the material in the label attaching apparatus. Therefore, this type of label attaching apparatus needs no special member for attaching the label on the material, other than the label attaching member. From this point of view, the label attaching apparatus can be more simple.

However, it is difficult for the air blow type label attaching apparatus to maintain the position of the label when the label is transferred to the material. Therefore, the label is easily kinked or bent and the attached label is wrinkled or crumpled. In addition, the problem that the dislocation of the position where the label should be attached easily occurs arises. When the distance between the label holder and the material while the label is being transferred from the label holder to the material is large, these problems are more significant. When the label is attached on several kinds of material having different sizes and shapes, the distance between the label holder and the material sometimes cannot be sufficiently reduced.

It is therefore an object of the present invention to provide a label attaching apparatus in which when the distance between the label holder and the surface to which the label will be attached is variable, an inversion or a dislocation of the position at which the label will be attached does not arise, and the label can stably be attached at the required position, and which has an improved the attaching speed.

SUMMARY OF THE INVENTION

According to a first aspect of the present invention, the present invention provides a label attaching apparatus for attaching a label on the material, comprising a label holder provided with a label sucking face for sucking and holding the label thereon wherein the label holder comprises at least one air blowout chamber for supplying air supplied from an air source into a plurality of air blowout pipes having openings formed at the label sucking face, and at least one air suction chamber for dividing negative pressure due to the air suction source into a plurality of air suction pipes having openings formed at the label sucking face.

According to the label attaching apparatus, the plurality of air blowout pipes are connected to the common air blowout chamber; therefore, the air blowout pipes can blow air uniformly and approximately in an instant. Moreover, the plurality of air suction pipes is also connected to the common air suction chamber; therefore, the air suction pipes can suck air uniformly and approximately in an instant. Consequently, it is possible to change between air suction and air blow in an instant, and reliably transfer the label to the material.

According to the second aspect of the present invention, the present invention provides a label attaching apparatus, wherein the label sucking surface comprises at least one recess perpendicularly formed to the longitudinal direction of the label sucking face, of which the bottom is provided with the openings of the air blowout pipes and the air suction pipes.

According to the label attaching apparatus, when the label is sucked at the label sucking face, the pressure inside of the recess is negative. Therefore, the label is sucked at the openings of the recesses, and is held reliably by the label holder. When the label is released from the label sucking face, air is blown out from all of the openings of the air blowout pipes positioned at the bottom of the recesses. Therefore, it is possible to transfer the label toward the material while the position of the label is reliably maintained.

According to the third aspect of the present invention, the present invention provides a label attaching apparatus, wherein said label holder moves to a label receiving position A where the label holder receives the label from the label transfer mechanism by sucking the label with the label sucking face, a label releasing position B where the label holder releases and transfer the label toward the material, and a waiting position C between the label receiving position A and the releasing position B in a movement of the label holder, and further comprises a label transfer mechanism for transferring the label to the label receiving position A along a label transfer direction, a drive mechanism for the label holder which transfers the label holder from the initial position to the label receiving position A, and from the label receiving position A to the waiting position C in a parallel manner, and a rotation mechanism for the label holder which moves the label holder from the waiting position C to the label releasing position B by rotating the label holder positioned at the waiting position C so that the label sucking face of the label holder faces the surface of the material.

According to the label attaching apparatus, the label transfer mechanism transfers the label to the label receiving position A. When the label holder moves from the initial position to the label receiving position A by the operation of the drive mechanism, the label holder starts air suction. Then, the label at the label receiving position A is sucked by the label sucking face, and held by the label holder. The label holder holding the label moves to the waiting position C by operation of the drive mechanism. When the material is transferred to the label releasing position B, the label holder moves from the waiting position C to the label releasing position B by operation of the rotation mechanism.

According to the fourth aspect of the present invention, the present invention provides a label attaching apparatus, wherein the label holder comprises a positioning member for the label formed at the label sucking face.

According to the label attaching apparatus, the label can be always held at a fixed position of the label sucking face. Therefore, it is possible to attach exactly the label to the required position of the surface of the material.

According to the fifth aspect of the present invention, the present invention provides a label attaching apparatus, wherein the openings of the air blowout pipes which are positioned at least one part of the edges of the label are closed.

A resistance of air (abbreviated as "open air" below) other than air blowing from the air blowout pipes applied to the center part of the label is larger than that of the open air applied to the edge parts of the label. Therefore, when the label which is easily bent, such as thin label and the soft label is transferred toward the material by air blow, the label is bent due to the air resistance of open air. Then, the edges of the label reaches at the surface of the material faster than the center part of the label. This phenomenon causes wrinkles of the attached label.

According to the label attaching apparatus, the openings of the air blowout pipes which are positioned at least one part of the edges of the label are closed. Thereby, at least one part of the edges of the label, where is applied a most small air resistance, is not received air. Therefore, it is possible to prevent the bend of the label, and to reach the edges and the center part of the label approximately at the same time.

Moreover, it is preferable that the openings of the air blowout pipes which are positioned at the entire edges of the label are closed, depending on the shape of the label.

According to the sixth aspect of the present invention, the present invention provides a label attaching, wherein further comprises a material. transfer mechanism for transferring the material in a transferring direction, and the diameter of the openings of the air blowout pipes which are positioned at the downstream side in the transferring direction of the material are larger than that of the openings of the air blowout pipes which are positioned at the upstream side.

According to the label attaching apparatus, an amount of air blown from the opening of the air blowout pipes positioned at the downstream side is larger than that of air blown from the opening of the air blowout pipes positioned at the upstream side. Therefore, the end of the label at the downstream side reaches to the material faster than the other end at the upstream side. Moreover, the label is attached on the material being transferred. Therefore, the material, to which only one end of the label is attached reliably and the other end of the label is not attached or weakly attached, is transferred in a transfer direction. As the material is transferred in the transfer direction, that is, as the label is transferred from the upstream side to the downstream side, the label is pushed toward the material with a larger air force. Thereby, the part of the label which is not attached or weakly attached on the material is attached reliably on the material in sequence. Consequently, wrinkles are not hardly formed in the attached label.

According to the seventh aspect of the present invention, the present invention provides a label attaching apparatus, wherein further comprises a blower for attaching the label.

According to the label attaching apparatus, after the label is transferred and attached to the material by the label holder, the blower blows air with high power to the label transferred to the material so that the label is reliably attached on the material. Therefore, it is possible to attach more reliably the label on the material.

According to the eighth aspect of the present invention, the present invention provides a label attaching apparatus, wherein a plurality of recesses are formed at the label sucking face of the label holder so as to remove the side surface of the label holder, at where the opening is formed.

According to the label attaching apparatus, the label is transferred by the label transfer mechanism to the label receiving position A, entered into the inside of the label positioning member, and held at a required position at the label sucking face. Moreover, the grooves are formed at the label sucking face so as to removes the side surface of the label holder, at where the opening is formed. The grooves having a such structure are formed at the label holder, and air suction starts, negative pressure inside of the grooves is not sufficient directly to suck the label. Therefore, the label can be transferred to the required position where the label contacts the inner wall of the positioning member by utilizing the time lag.

According to the ninth aspect of the present invention, the present invention provides a label attaching apparatus, wherein the label holder comprises a label receiver for receiving an unnecessary label, which moves between a position in which the label receiver faces the label sucking face and a position which is far from the label sucking face.

According to the label attaching apparatus, when the label holder holds an unnecessary label such as a label of which the conditions before attachment are not good, the unnecessary label can be recovered and disposed by moving the label receiver to the position where the label receiver faces the label sucking face and stopping an air suction, thereby the unnecessary label is transferred from the label sucking face to the label receiver. Therefore, it is possible to recover and dispose the unnecessary label.

DESCRIPTION OF THE PREFERRED EMBODIMENTS

Embodiments of the label attaching apparatus according to the present invention will be explained referring to the figures. Moreover, a label in a rectangle shape having long and short sides is used in the following embodiments. However, the shape of the label is not limited to a rectangle shape. The label attaching apparatus of the present invention can use labels having absolutely any shape such as triangle, square, polygon, cycle, ellipse, and undefined shape.

First Embodiment

Figure 1:
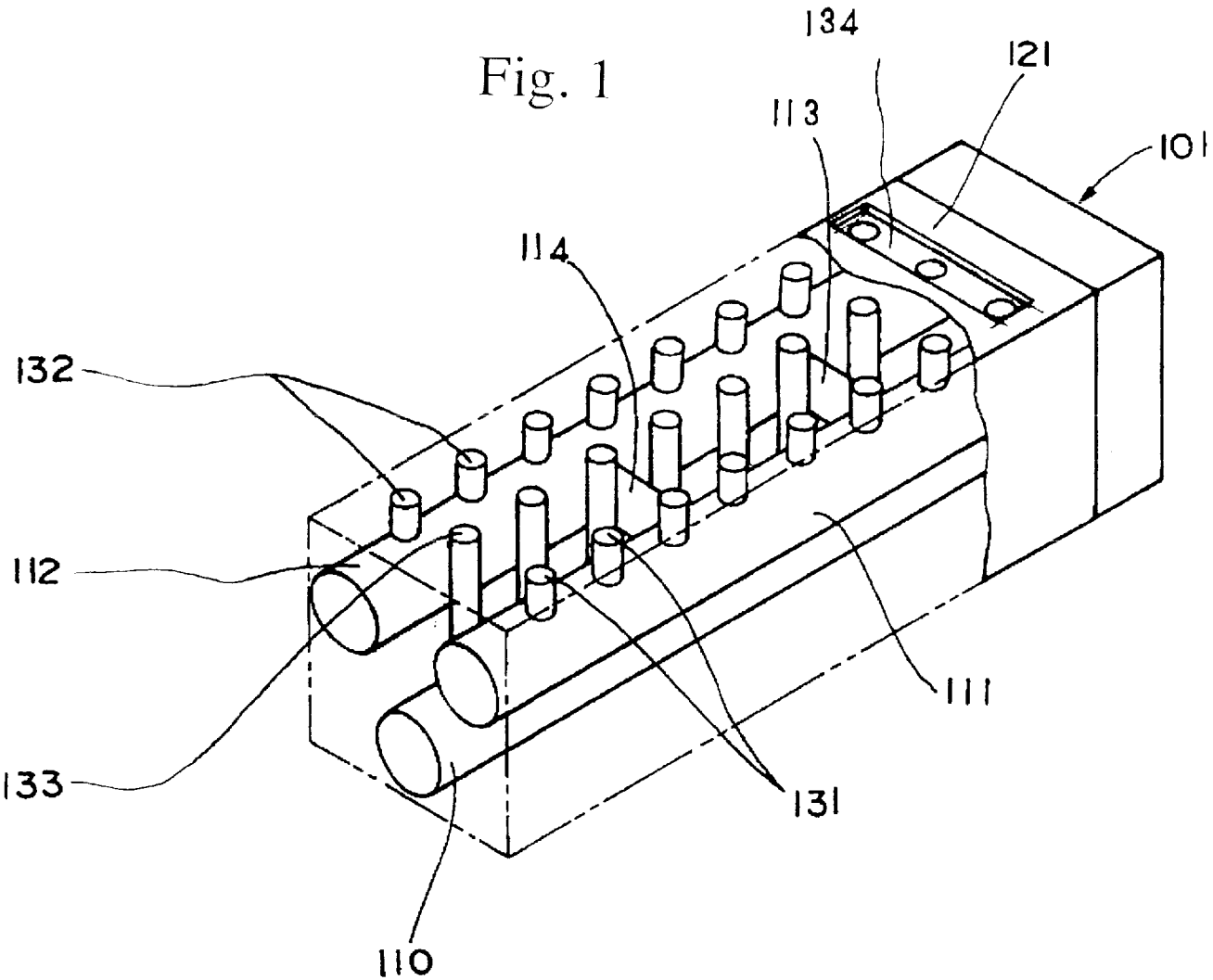
FIG. 1 is a perspective view showing the label holder having a partial broken-out section, which comprises a first embodiment of the label attaching apparatus according to the present invention.

As shown in FIG. 1, a label holder 101 comprises two air blowout chambers 111 and 112 and an air suction chamber 110 which is arranged between the two air blowout chambers 111 and 112 and the level of which is different to that of the air blowout chambers 111 and 112. In addition, two air connection pipes 113 and 114 are provided with the two air blowout chambers 111 and 112 so as to divide the two air blowout chambers 111 and 112 into three equal parts in a longitudinal direction. The air connection pipes 113 and 114 connect the air blowout chambers 111 and 112. The label holder 101 is provided in a label holding device (not shown in FIG. 1).

Moreover, the air suction chamber 110 and the air blowout chambers 111 and 112 shown in FIG. 1 are in a cylindrical shape. However, as far as air supplied from an air source (not shown in the figures) can be divided equally into a plurality of blowout air pipes 131 and 132 explained below, or negative pressure generated by an air suction member (not shown in the figures) can be divided equally into air suction pipes 133 explained below, the shape of the air suction chamber 110 and the air blowout chambers 111 and 112 is not limited to a cylindrical shape.

Figure 2:
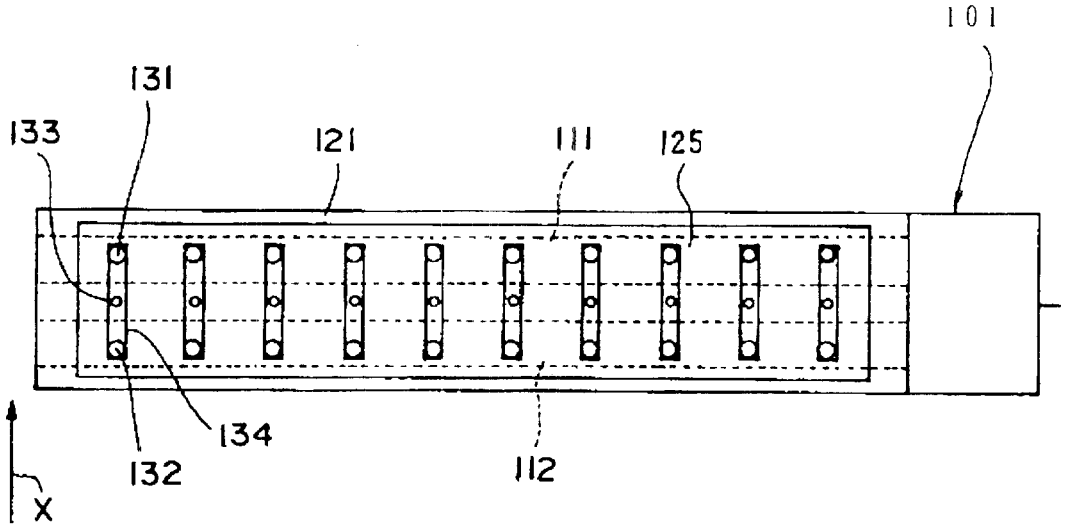
FIG. 2 is a planar view showing the label holder shown in FIG. 1.

The label holder 101 comprises a label sucking face 121. A label is sucked by the label sucking face 121. Specifically, as shown in FIG. 2, the label is sucked by a label sucking area 125 at the label sucking face 121. A plurality of recesses 134 are formed in the label sucking area 125 so as to cross a longitudinal direction of the label sucking area 125 and be positioned at regular intervals. Moreover, ten recesses 134 are formed in the label sucking area 125 in this embodiment. It is preferably to change the number and the position of the recess 134 depending on a shape and a size of the label sucked at the label sucking area 125.

A plurality of air blowout pipes 131 and 132 and air suction pipes 133 which extend to the label sucking face 121 are provided respectively in the air blowout chambers 111 and 112 and the air suction chamber 110. The air blowout pipes 131 and 132 and the air suction pipes 133 are positioned in a longitudinal direction of the label sucking area 125 so as to maintain a regular interval equal to that of the recesses 134. That is, the openings of the air blowout pipes 131 and 132 and air suction pipes 133 reach to the bottom of the recesses 134. The openings are air blowout openings and air suction openings.

In general, a label is remarkably light; therefore, only small amount of air is sufficient to suck the label at the label sucking surface 121. However, in order to separate the label from the label sucking face 121 and transfer it reliably and speedily to the material, it is necessary to blowout a sufficient amount of air from the air blowout pipes 131 and 132. Therefore, it is preferably to design the diameter of the openings of the air blowout pipes 131 and 132 larger than that of the openings of the air suction pipes 133.

Figure 3:
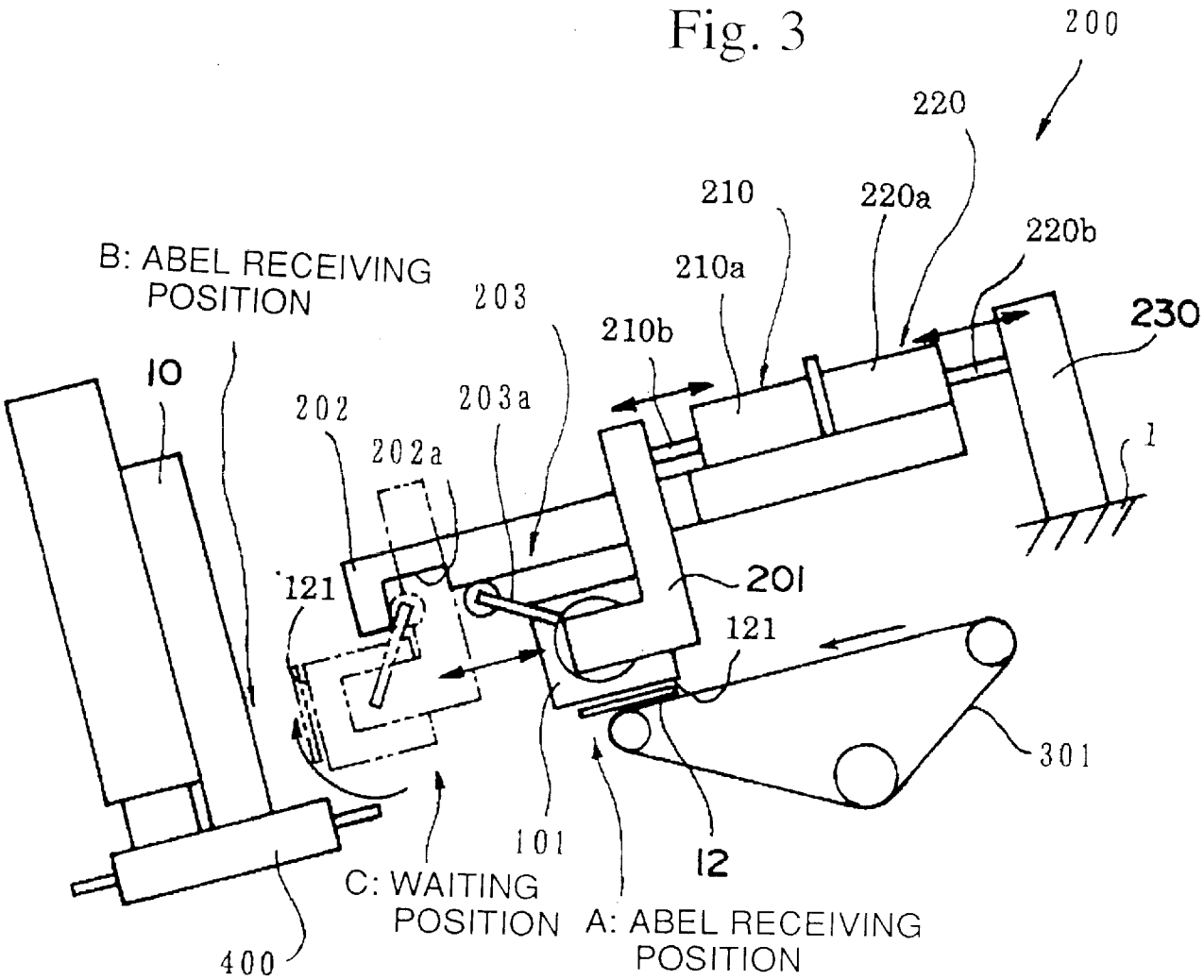
FIG. 3 is a schematic view for explaining a drive mechanism for moving the label holder from a label receiving position to a label releasing position and rotating the label holder.

For example, the label holder 101 can be provided in a driving mechanism 200 shown in FIG. 3. The constitution of the driving mechanism 200 will be explained below with reference to FIG. 3.

A support member 230 is provided with a body 1 of the label attaching apparatus. Two cylinders 210 and 220 which respectively operate as a moving member by orders from a control part (not shown in the figures) are provided with the support member 230. The cylinders 210 and 220 comprise respectively bases 210*a* and 220*a* and piston rods 210*b* and 220*b*. The piston rod 210*b* of the cylinder 210 is connected to a slider 201 explained below. A piston rod 220*b* of the other cylinder 220 is connected to the support member 230.

The bases 210*a* and 220*a* of the cylinders 210 and 220 are provided with a guide 202 extending toward a material transfer mechanism 400 for a material 10. The slider 201 is provided so as to move along the guide 202 in the front and rear direction. The label holder 101 is provided with the slider 201. Furthermore, a label transfer mechanism 301 for transferring a label 12 in the direction indicated by the arrow shown in FIG. 3 is provided under the guide 202. The label 12 is transferred from the label transfer mechanism 301 to the label holder 101 at a label receiving position A on the label transfer mechanism 301.

The material transfer mechanism 400 maintains the position of the material 10 so as to stand obliquely as shown in FIG. 3. The label 12 is released from the label holder 101 toward the material 10 at a label releasing position B. The label holder 101 is provided with the slider 201 so as to rotate freely between the label receiving position A and the label releasing position B by a rotation mechanism 203.

When the label holder 101 which receives and releases the label 12 by rotating between the label receiving position A and the label releasing position B is compared with a label holder which receives and releases the label 12 by parallel moving between the label receiving position A and the label releasing position B, a moving distance for receiving and releasing the label 12 of the label holder 101 which rotates is shorter than that of the label holder which moves in a parallel manner. Therefore, the label attaching apparatus comprising the label holder 101 which rotates can be compact.

As far as the label holder 101 can rotate between the label receiving position A and the label releasing position B, any known rotation mechanism can be used as the rotation mechanism 203 of the label holder 101. In this embodiment, an edge of an arm 203*a* which extends upwardly from the label holder 101 toward the material transfer mechanism 400 always contacts the guide 202. In addition, a recess 202*a* is formed at the edge near the material transfer mechanism 400 of the guide 202. When the edge of the arm 203*a* falls into the recess 202*a* formed in the guide 202 by moving the slider 201 and contacts the inner wall near the material transfer mechanism 400 of the recess 202*a*, the label holder 101 cannot move parallel to the guide 202 together with the slider 201. However, the slider 201 further moves toward the material transfer mechanism 400 along the guide 202. Then, the arm 203*a* rotates clockwise in a direction indicated by the arrow shown in FIG. 3 while the edge of the arm 203*a* is used as a rotation center of the arm 203*a*. Thereby, the label holder 101 also rotates clockwise. The rotation mechanism 203 is remarkably simple, and can rotate the label holder 101 quickly at a required angle.

The label sucking face 121 comes as close as possible toward a label carrying surface of the label transfer mechanism 301 at the label receiving position A. Therefore, the label 12 on the label carrying surface is sucked at the label sucking surface 121 by sucking a small amount of air from the air suction pipes 133.

Moreover, it is preferably to adjust the distance between the surface of the material to which the label 12 will be attached and the label sucking face 121 at the label releasing position B so as to be smallest, with taking account of a variation of the thickness of the material 10 carried by the material transfer mechanism 400. That is, it is preferably to adjust the distance between the surface of the material 10 having the greatest thickness and the label sucking face 121 so that it is smallest.

Below, actions of the label attaching apparatus will be explained.

In the initial condition, the piston rods 210*b* and 220*b* of the cylinders 210 and 220 are fit into the bases 210*a* and 220*a*. Thereby, the label holder 101 is positioned at the label receiving position A while the label sucking face 121 faces the label transfer mechanism 301. When the label 12 is transferred to the label receiving position A by the label transfer mechanism 301, air in the air suction chamber 110 is sucked by a sucking member (not shown in the figures) provided outside of the label holder 101. Then, air is sucked from a plurality of air suction pipes 133 of which the openings are formed at the label sucking face 121, and the label 12 is sucked by the label sucking face 121, specifically, at the openings of the recesses 134.

In this embodiment, the openings of the air suction pipes 133 are formed at the bottoms of the recesses 134 having a width narrower than that of the label 12. Therefore, the label 12 is sucked at the label sucking face 121 by contacting the label 12 with the top surface of the space in the recess 134. Consequently, the label 12 is reliably held by the label holder 101.

When the label sucking face 121 of the label holder 101 sucks the label 12, the cylinder 210 is driven by an order from the control part (not shown in the figures). The piston rod 210*b* is extended, and pushes the label holder 101 toward the material transfer mechanism 400 together with the slider 201. The label holder 101 rotates at the edge of the guide 202 by the rotation mechanism 203 as explained above, and the label sucking face 121 faces toward the label releasing position B.

When the material 10 is carried to the label releasing position B by the material transfer mechanism 400, the cylinder 220 is driven and the piston rod 220*b* is extended. Thereby, the guide 202 moves toward the material transfer mechanism 400. Then, the label 12 sucked at the label sucking face 121 is positioned at the label releasing position B.

The control part stops the operation of an air suction member, such as vacuum pump which sucks air inside of the air suction chambers 110, and starts the operation of an air blowout member, such as a blower which supplies air to the air blowout chambers 111 and 112. Thereby, air blowouts from a plurality of the air blowout pipes 131 and 132 approximately at the same time, and sends the label 12 to the material 10.

Moreover, the components shown in FIGS. 4 to 12 which are the same as the components shown in FIGS. 1 to 3 have the same reference numerals as shown in FIGS. 1 to 3. Thereby, an explanation for those same components is omitted in the following embodiments.

Second Embodiment

Figure 4:
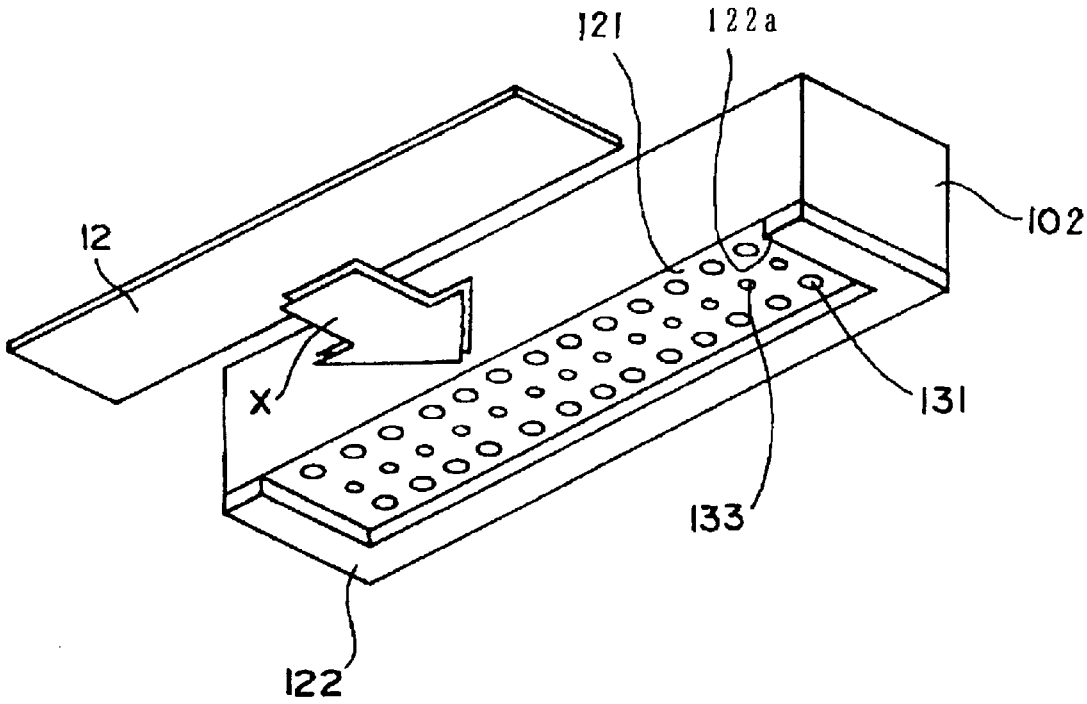
FIG. 4 is a perspective view showing the label holder comprising a second embodiment of the label attaching apparatus according to the present invention.

FIG. 4 is a perspective view showing the label holder 102 comprising a second embodiment of the label attaching apparatus according to the present invention. In this embodiment, a positioning member 122 in a square sided C-shape, which opens so that the label 12 can enter in a direction indicated by the X arrow, is provided with the label sucking face 121 of the label holder 102.

Moreover, in order to adjust for small dislocations of the label 12 carried in the X direction by the label transfer mechanism 301, it is preferable to form the edges of the positioning member 122 forming the opening 122*a* in a taper or an arc.

The label holder 102 of this embodiment can also be provided with the drive mechanism 200 of the first embodiment, shown in FIG. 3. That is, the label holder 102 is provided with the slider 201 so that the opening 122*a* of the positioning member 122 faces to the upstream side in the label carrying direction indicated by the arrow in FIG. 3, which is formed by moving the label transfer mechanism 301. The label 12 carried by the label transfer mechanism 301 enters into the positioning member 122 from the opening 122*a*, contacts the inner wall of the positioning member 122, and is positioned.

According to this embodiment, it is possible to prevent the irregularity of the suction position of the label 12 at the label suction face 121. Therefore, the label attaching apparatus of this embodiment can reliably attach the label 12 at the position specified in advance of the material 10.

Third Embodiment

In the first and second embodiments, it is preferable that the same amount of air is blown from each air blowout pipe 131 and 132. However, in fact, the amount of air blown from each blowout air pipe 131 and 132 is varied depending on the size of the air blowout chambers 111 and 112 with respect to a size of the air blowout pipes 131 and 132, the number and the position of the air blowout pipes 131 and 132. It is difficult to make the amount of air blown from each blowout air pipes 131 and 132 uniform.

To the extent that the label 12 is thin and the area with respect to the thickness of the label 12 is large, problems due to the ununiformity of the amount of air blowing from each air blowout pipe 131 and 132 is significant. That is, when the label 12 is attached on the material, wrinkle L shown in FIGS. 5A and 5B is easily formed.

Figure 5A:
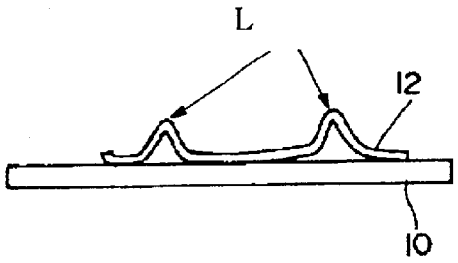
FIGS. 5A and 5B are views for explaining the form of a wrinkle of the attached label.
Figure 5B:
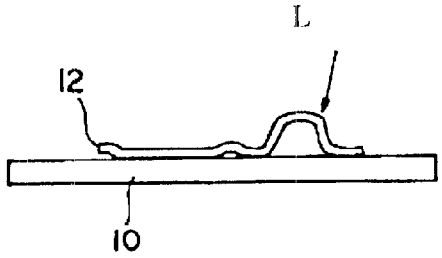
Figure 6:
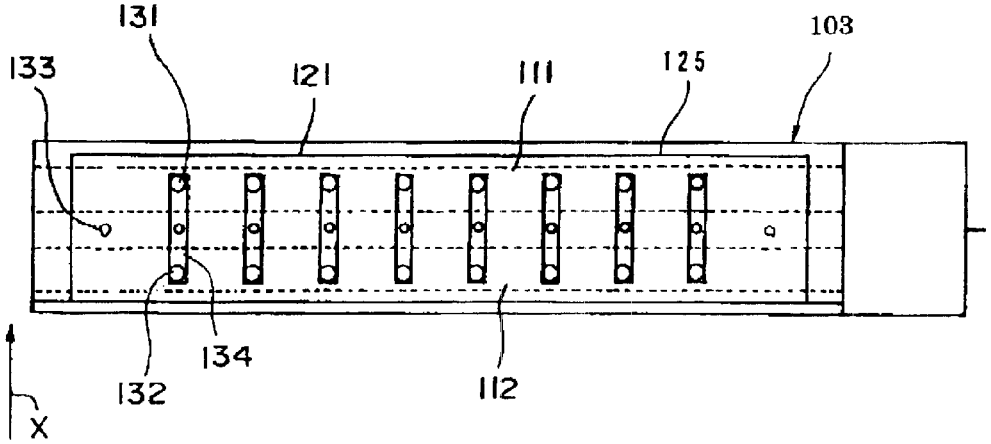
FIG. 6 is a schematic view showing the label holder which can improve the generation of the wrinkle shown in FIGS. 5A and 5B, which comprises a third embodiment of the label attaching apparatus according to the present invention.

FIG. 6 is a schematic view showing the label holder 103 which can improve the generation of the wrinkle shown in FIGS. 5A and 5B. When the thin label 12 is transferred to the material 10, the entire label 12 receives uniform air force from the label holder 101 and 102, the air resistance of open air applied to the center part of the label 12 is larger than that of the open air applied to the edge parts of the label 12. Therefore, the center part of the label 12 expands, and the label 12 bends. Then, the edge parts of the label 12 reach the material 10 faster than the center part of the label 12. Therefore, it is believed that one or more wrinkles are formed along the width direction of the label 12, as shown in FIGS. 5A and 5B.

In order to solve the problem, the openings of the air blowout pipes 131 and 132 which are positioned on at least one part of the edges of the label 12 are closed. Specifically, the openings of the air blowout pipes 131 and 132 which are positioned at both ends in a longitudinal direction of the label suction area 125 are closed, as shown in FIG. 6, in this embodiment. Thereby, both ends of the label 12 in the longitudinal direction of the label 12 do not receive air from the label holder 103. According to the label attaching apparatus comprising the label holder 103 in this embodiment, the air force due to the label holder 103 to the label 12 with respect to the resistance of the open air can be adjusted, that is, the entire label 12 is pushed uniformly toward the material 10. Therefore, the generation of the wrinkles in the attached label 12 can be prevented.

Fourth Embodiment

Figure 7:
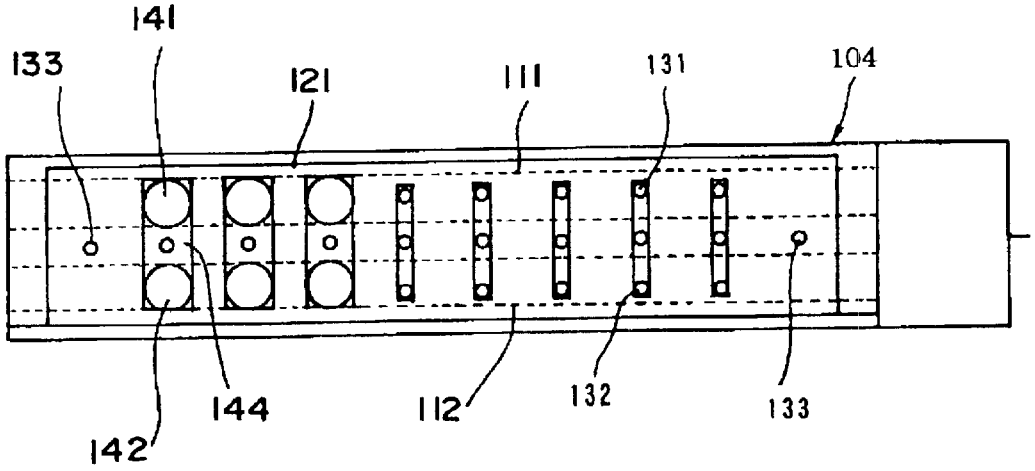
FIG. 7 is a planar view showing the label holder comprising a fourth embodiment of the label attaching apparatus according to the present invention.

FIG. 7 is a planar view showing the label holder 104 comprising a fourth embodiment of the label attaching apparatus according to the present invention.

Openings of the air blowout pipes 131 and 132 at both ends in a longitudinal direction of the label sucking face 121 are closed in the label holder 104, similar to the label holder 103 in the third embodiment. In addition, the diameter of the openings of the air blowout pipes 141 and 142 arranged at one side in a longitudinal direction of the label sucking face 121 is larger than that of the openings of the air blowout pipes 131 and 132 arranged at the other side. The width of the recesses 144 for the openings of the air blowout pipes 141 and 142 enlarges.

According to the label attaching apparatus comprising the label holder 104 in this embodiment, an amount of air blowing from the air blowout pipes 141 and 142 having a large diameter is larger than that of the air blowing from the air blowout pipes 131 and 132 having a small diameter. Therefore, it is possible to press the label 12 with a large air force toward the material 10 at one side in a longitudinal direction of the label sucking face 121.

Figure 8:
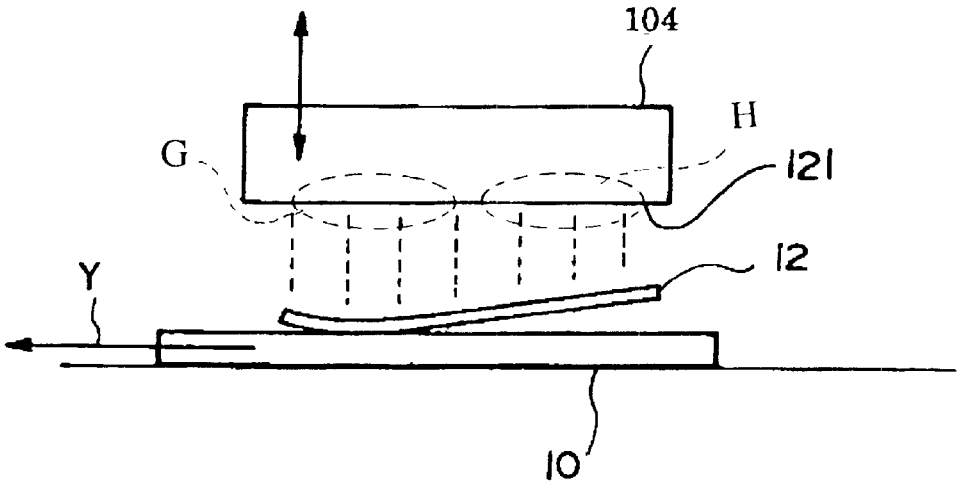
FIG. 8 is a schematic view for explaining a function of the label holder shown in FIG. 7.
Figure 9:
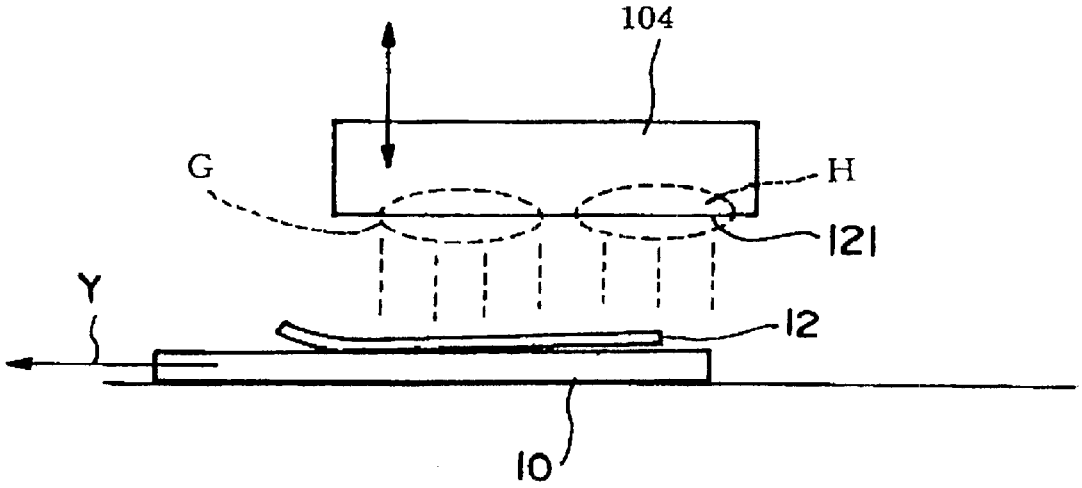
FIG. 9 is a schematic view for explaining a function of the label holder shown in FIG. 7.

FIGS. 8 and 9 are a schematic view for explaining a function of the label holder 10 104 shown in FIG. 7. As explained above, the openings of the air blowout pipes 131, 132, 141, and 142 are provided at the label sucking face 121 of the label holder 104. That is, the openings of the air blowout pipes 141 and 142 positioned at the downstream side, in a transfer direction indicated by the arrow Y, that is, at an area G, is larger than those of the air blowout pipes 131 and 132 positioned at the upstream side, that is, at an area H. Thereby, when air is blown from the label holder 104, the area G blows air with an air force larger than that of the area H. Therefore, the end of the label 12 at the downstream side in the transfer direction reaches the surface of the material 10 faster than the other end of the label 12. Moreover, the label 12 is attached on the material 10 being transferred by the material transfer mechanism 400. Therefore, the material 10, to which only one end of the label 12 in a longitudinal direction of the label 12 is attached and the other end of the label 12 is not attached or weakly attached, is transferred in a transfer direction. Moreover, while the material 10 is transferred in the transfer direction, air is blown out from the air blowout pipes 131, 132, 141, and 142 so as to push the label 12 toward the material 10. Therefore, as the material 10 is transferred in the transfer direction Y, that is, as the label 12 is transferred from the area H to the area G of the label holder 104, the label 12 is pushed toward the material 10 with a larger air force. Thereby, the part of the label 12 which is not attached or weakly attached on the material 10 is attached reliably on the material 10 in sequence. Consequently, wrinkles are not hardly formed in the attached label 12.

Fifth Embodiment

Figure 10:
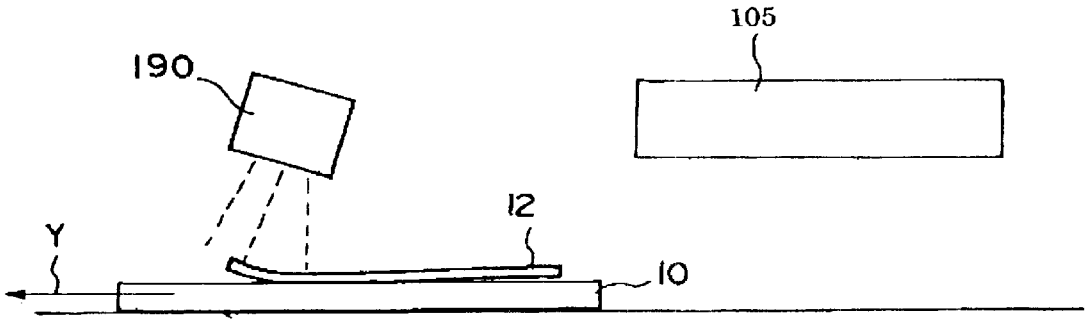
FIG. 10 is a schematic view for explaining a fifth embodiment of the label attaching apparatus according to the present invention.

FIG. 10 is a schematic view for explaining a fifth embodiment of the label attaching apparatus according to the present invention.

In the first to the fourth embodiments, the label 12 is pushed toward and attached on the material 10 by air blowing from the label holder 101 to 104. However, after the label 12 is transferred to the material 10 by the label holder 105, a blower 109 blows air with high power to the label 12 transferred to the material 10 so that the label 12 is reliably attached on the material 10 in this embodiment. According to the label attaching apparatus in this embodiment, the label 12 is more reliably attached on the material 10.

Sixth Embodiment

Figure 11:
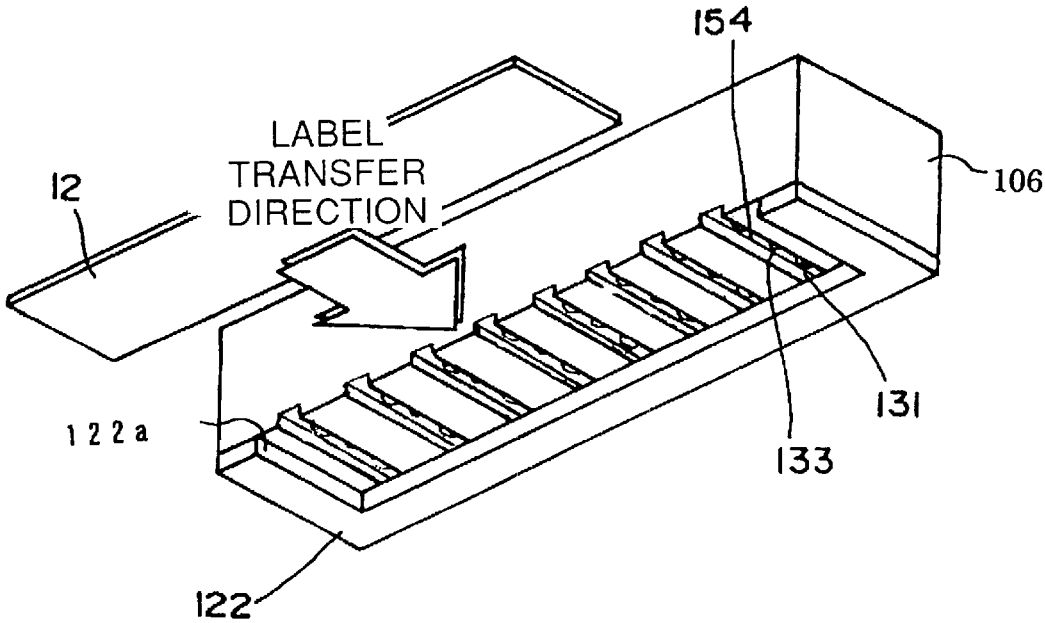
FIG. 11 is a perspective view showing the label holder comprising a sixth embodiment of the label attaching apparatus according to the present invention.

FIG. 11 is a perspective view showing the label holder 106 comprising a sixth embodiment of the label attaching apparatus according to the present invention. The label holder 106 is provided with the positioning member 122 explained in the second embodiment.

In order to shorten the period for attaching the label 12 on the material 10, it is preferable to start air suction as quickly as possible. However, when air suction starts before the label 12 enters from the opening 122*a* in the positioning member 122 and contacts the inner wall of the positioning member 122, the position of the label 12 at the label holder 106 is indefinite. Therefore, it is difficult to attach reliably the label 12 at the required position of the material 10.

In order to solve the problem, grooves 154 are formed at the label sucking face 121 of the label holder 106 so as to removes the side surface of the label holder 106, at where the opening 122*a* is formed. That is, the grooves 154 removes the side surface of the label holder 106 where the label 12 enters. Moreover, the openings 131, 132, 141, and 142 of the air blowout pipes are formed at the bottom of the grooves 154.

When the grooves 154, having such a structure, are formed at the label holder 106, and air suction starts, negative pressure inside of the grooves 154 is not sufficient directly to suck the label 12. Therefore, the label 12 can be transferred to the position where the label 12 contacts the inner wall of the positioning member 121 by utilizing the time lag.

Moreover, the grooves 154 may be directly formed in the label holder 106. However, the grooves 154 may be formed at the label sucking face 121 which can be freely put on and taken off the label holder 106.

Seventh Embodiment

Figure 12:
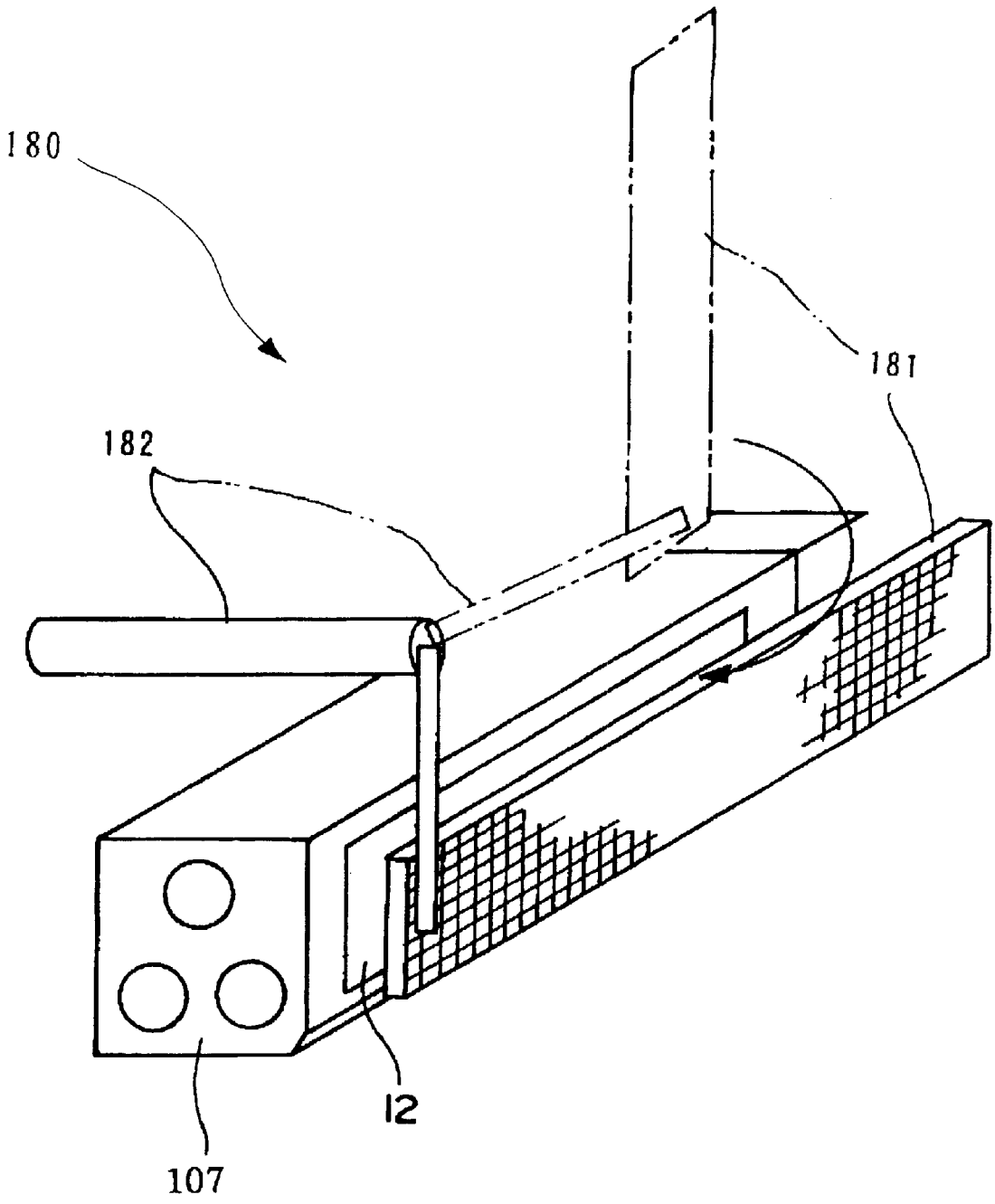
FIG. 12 is a perspective view showing the label holder comprising a seventh embodiment of the label attaching apparatus according to the present invention.

FIG. 12 is a perspective view showing the label holder 107 comprising a seventh embodiment of the label attaching apparatus according to the present invention.

In some cases, an attachment of the label 12 is not necessary depending on the kind of the material 10. In addition, in some cases, a trial run for adjusting each part comprising the label attaching apparatus is carried out using a label having printed no printed information, before a real run is carried out. Furthermore, in some cases, a label check member (not shown in the figures) judges whether the label conditions before attachment is good. In order to recover and dispose of these unnecessary labels 12, a label recovery member 180 is provided with the label attaching apparatus in this embodiment.

The label recovery member 180 comprises a label receiver 181 for receiving unnecessary label 12, a supporter 182 for supporting the label receiver 181 so that it can rotate freely, and a rotation driver (not shown in FIG. 12) for rotating the supporter 182 and thereby rotating the label receiver 181 between the position where the label receiver 181 faces the label sucking face 121 and the position where the label receiver 181 is far from the label sucking face 121 and which is indicated by a two-dot chain line. The label receiver 181 comprises preferably a net body or a porous body, in order to be able to pass through air blowing from the label holder 107 when the unnecessary label 12 is released from the label holder 107.

When the label holder 107 receives the unnecessary label 12 from the label transfer mechanism 301, the label holder 107 moves to a waiting position C by cylinder 210, as shown in FIG. 3. The label receiver 181 rotates from the position where is far from the label sucking face 121 to the position in where the label receiver 181 faces the label sucking face 121 at the waiting position C by the rotation driver. Maintaining the position of the label receiver 181, air suction for sucking the label 12 is stopped. Then, the unnecessary label 12 is transferred to the label receiver 181 by blowing air. The label receiver 181 receiving the unnecessary label 12 rotates to the position where the label receiver 181 is far from the label sucking face 121. For example, the unnecessary label 12 is dropped from the label receiver 181 by rotating the label holder 107 using the rotation mechanism 203, and is disposed.

The preferred embodiments of the label attaching apparatuss according to the present invention are explained above. However, the label attaching apparatus of the present invention is not specifically limited to these embodiments.

For example, in order to solve the problem that a resistance of open air applied to the center part of the label 12 in a rectangle is larger than that of open air applied to the edge parts of the label 12 in a rectangle, and the label 12 bends, the openings of the air blowout pipes 131, 132, 141, and 142 at both ends in a longitudinal direction of the label suction area 125 are closed in the third and fourth embodiments. However, it is preferable that the openings of the air blowout pipes 131, 132, 141, and 142 are arranged while considering that the value of the air resistance and the position where the wrinkles are generated depends on the shape and the size of the label 12.

Moreover, the label holder 101 to 107 is provided with two air blowout chambers 111 and 112 in the first to seventh embodiments. However, only one air blowout chamber or three or more air blowout chambers may be provided with the label holder 101 to 107.

Furthermore, the label receiver 181 can rotate freely in the seventh embodiment. However, as far as the label receiver 181 can move between the position where the label receiver 181 faces to the label sucking face 121 and the position where the label receiver 181 is far from the label sucking face 121, the label receiver 181 may move in a parallel manner.

What is claimed is:

1. A label attaching apparatus for attaching a label on a material, comprising:

a label holder having a label sucking face for sucking and holding said label, wherein said label holder comprises:

at least one air blowout chamber for supplying air supplied from an air source into a plurality of air blowout pipes having openings formed at the label sucking face, and at least one air suction chamber for dividing negative pressure due to the air suction source into a plurality of air suction pipes having openings formed at the label sucking face, wherein said label attaching apparatus further comprising a material transfer mechanism for transferring the material in a transferring direction, wherein a diameter of the openings of the air blowout pipes which are positioned at the downstream side in the transferring direction of the material are larger than a diameter of the openings of the air blowout pipes which are positioned at the upstream side.

2. The label attaching apparatus according to claim 1, wherein said label sucking surface comprises at least one recess perpendicular to the longitudinal direction of the label sucking face, wherein said at least one recess includes at least one of the openings of the air blowout pipes and the air suction pipes; and wherein the air blowout pipes and the air suction pipes are separately provided.

3. The label attaching apparatus according to claim 1, wherein said label holder:

moves to a label receiving position (A);

receives the label from a label transfer mechanism by sucking the label with the label sucking face;

moves to a label releasing position (B);

releases and transfers the label toward the material; and moves to a waiting position (C) between the label receiving position (A) and the releasing position (B), wherein said label holder further comprises:

said label transfer mechanism for transferring the label to the label receiving position (A) along a label transfer direction;

a drive mechanism for the label holder which transfers the label holder from the initial position to the label receiving position (A), and from the label receiving position (A) to the waiting position (C) in a parallel manner; and a rotation mechanism for the label holder which moves the label holder from the waiting position (C) to the label releasing position (B) by rotating the label holder positioned at the waiting position (C) so that the label sucking face of the label holder faces the surface of the material.

4. The label attaching apparatus according to claim 3, wherein a plurality of recesses are formed at the label sucking face of the label holder.

5. The label attaching apparatus according to claim 1, wherein said label holder comprises a positioning member for the label, said positioning member formed at the label sucking face.

6. The label attaching apparatus according to claim 5, wherein said positioning member is in a square sided C-shape, wherein said positioning member has an opening so that the label can enter inside of the positioning member.

7. The label attaching apparatus according to claim 1, wherein at least one of said openings of the air blowout pipes that is positioned on at least one part of an edge of the label, is closed.

8. The label attaching apparatus according to claim 1, said label attaching apparatus further comprising a blower for attaching the label to the material.

9. The label attaching apparatus according to claim 1, wherein the air blowout pipes and the air suction pipes are separately provided, wherein said label sucking surface comprises at least one recess perpendicular to the longitudinal direction of the label sucking face, wherein said at least one recess includes the air blowout pipes and the air suction pipes, and wherein said openings of the air blowout pipes which are positioned on at least one part of an edge of the label are closed.

10. A label attaching apparatus for attaching a label on a material, comprising:

a label holder having a label sucking face for sucking and holding said label, wherein said label holder comprises:

at least one air blowout chamber for supplying air supplied from an air source into a plurality of air blowout pipes having openings formed at the label sucking face, and at least one air suction chamber for dividing negative pressure due to the air suction source into a plurality of air suction pipes having openings formed a the label sucking face, wherein said label holder comprises a label receiver for receiving an unnecessary label, which moves between a position where the label receiver faces the label sucking face and a position where the label receiver is positioned away from the label sucking face.

11. A label attaching apparatus for attaching a label on a material, comprising:

a label holder having a label sucking face for sucking and holding said label, wherein said label holder comprises:

at least one air blowout chamber for supplying air supplied from an air source into a plurality of air blowout pipes having openings formed at the label sucking face, and at least one air suction chamber for dividing negative pressure due to the air suction source into a plurality of air suction pipes having openings formed at the label sucking face, wherein said label holder comprises a plurality of air blowout chambers, and at least one air connection pipe for connecting said plurality of air blowout chambers, wherein said at least one air connection pipe divides said plurality of air blowout chambers into a plurality of equal parts in a longitudinal direction of said plurality of air blowout chambers.

* * * * *